US005875509A

United States Patent [19]

Facca

[11] Patent Number: 5,875,509

[45] Date of Patent: Mar. 2, 1999

[54] SELF-WRINGING MOP

[76] Inventor: Andrew G. Facca, 1022 Riverdale Avenue, Windsor, Ontario, Canada, N8S 3N6

[21] Appl. No.: 551,151

[22] Filed: Oct. 31, 1995

[51] Int. Cl.[6] ..... A47L 13/12; A47L 13/142

[52] U.S. Cl. ..... 15/120.1; 15/118; D32/51

[58] Field of Search ..... 15/116.1, 116.2, 15/118, 119.1, 119.2, 120.1, 120.2; D32/44, 50, 51

[56] References Cited

U.S. PATENT DOCUMENTS

| | | | |
|---|---|---|---|
| 695,043 | 3/1902 | Gee . | |
| 973,491 | 10/1910 | Fischer, Jr. | 15/120.2 |
| 1,224,524 | 5/1917 | Courtney . | |
| 1,514,051 | 11/1924 | Jumonville | 15/120.2 |
| 1,700,136 | 1/1929 | Leidgen . | |
| 1,710,190 | 4/1929 | Regan | 15/120.2 |
| 1,760,695 | 5/1930 | Hertzberg . | |
| 2,230,101 | 1/1941 | Bakemeier . | |
| 2,482,169 | 9/1949 | Finnell | 15/118 |
| 2,677,838 | 5/1954 | Jouban | 15/120.2 |
| 2,893,029 | 7/1959 | Vosbikian | 15/118 |
| 3,205,519 | 9/1965 | Nowlin | 15/118 |
| 4,178,650 | 12/1979 | Aasland | 15/120.1 |
| 4,479,278 | 10/1984 | Heinonen . | |
| 5,509,163 | 4/1996 | Morad | 15/120.2 |
| 5,566,417 | 10/1996 | Hsieh | 15/120.1 |

FOREIGN PATENT DOCUMENTS

| | | | |
|---|---|---|---|
| 2622785 | 5/1989 | France | 15/120.1 |
| 2740417 | 3/1978 | Germany | 15/120.2 |

OTHER PUBLICATIONS

Arma Products, "Miracle Mop™" Product Brochure published 1990, all pages.

Vining Industries, "Twist 'Mop™" Product Brochure published 1988, all pages.

Author Unknown, "Wonder Mop MC" Product Instructions published 1993, all pages.

*Primary Examiner*—Randall E. Chin

*Attorney, Agent, or Firm*—Young & Basile, P.C.

[57] ABSTRACT

A self-wringing mop is disclosed comprising an elongate handle with distal and proximal ends, a sleeve slidingly and rotatably disposed on the handle, and a swab both connected to the sleeve and removably threadingly connected to the distal end of the handle. The mop further includes indicia thereon, the indicia identifying at least a direction of rotation of the sleeve necessary to wring the swab.

21 Claims, 4 Drawing Sheets

SELF-WRINGING MOP

FIELD OF THE INVENTION

The present invention relates generally to self-wringing mops and more particularly to means for interchangeably connecting swabs to the handles of such mops.

BACKGROUND OF THE INVENTION

Mops of the type having various swab-wringing mechanisms are well known and have been the subject of numerous improvements over the years. One particularly common and popular form is the self-wringing mop. As taught by Hertzberg, U.S. Pat. No. 1,760,695, this type of mop consists of a swab comprising multiple strands of material fixed at opposing ends to both the distal end of a mop handle and a sleeve rotatably and slidably disposed on the mop handle. By extending the sleeve longitudinally towards the distal end of the mop handle, the swab functions in its normal fashion for mopping. Conversely, retracting the sleeve stretches the swab so that it may be wrung by rotating the sleeve about the longitudinal axis of the handle.

It is also known in self-wringing mops of the type described that the swab may be detachably connected to the handle in such a way as to permit the use of different swabs. In this manner, used or worn out swabs may also be replaced. For example, Heinonen, U.S. Pat. No. 4,479,278, teaches a swab having multiple strands sandwiched at one end between the threadingly-engageable portions of a fixing head, which portions comprise a cup-like seat and a locking body. At their opposite ends the multiple strands of the swab are gathered by a tie to define a circular opening. A mop handle having distal and proximal ends includes a sleeve slidingly and rotatably disposed thereon, the sleeve flaring outwardly toward the distal end of the mop handle to define a hemispherical portion over which the circular opening of the swab is engaged. The hemispherical portion defines a greater diameter than the swab's circular opening, such that the swab will not disengage the sleeve during use.

Unfortunately, self-wringing mops of this type are unnecessarily complex. In order to change swabs in the Heinonen device, for example, a user has to separate the locking body from the remainder of the fixing head and extricate the swab from the cup-like seat. Subsequently, the swab must also be removed from the sleeve. This presents two problems. First, the locking body may be misplaced or inadvertently broken when it is separated from the fixing head, rendering the mop useless. Second, a user must contact the dirtiest portion of a used or worn-out swab—the area adjacent the locking body—in order to remove the swab and put a new one in its place.

Still another problem common to self-wringing mops is the tendency of the sleeve to freely slide towards the distal end of the mop handle, particularly under the weight of a swab soaked with water, cleaning solution, or other liquid. Consequently, such prior art mops cannot be hung vertically with the swab fully stretched for drying.

One solution to this latter problem has been to include a locking element disposed in fixed position on the mop handle proximate the upper end of the sleeve. When the sleeve is fully retracted, this locking element is threadingly engaged with a correspondingly threaded portion provided on the upper end of the sleeve. With the locking element and the sleeve so engaged, the sleeve resists sliding along the handle.

While effective in retaining the sleeve in a fixed position when the mop is vertically oriented, the above solution increases both the cost of manufacture of the mop, as well as its complexity of use.

A second solution to this problem has been to provide a friction cap to the upper end of the sleeve. The cap fits over the mop handle and comprises a short cylindrical tube having upper and lower openings and means for connecting to the upper end of the sleeve in a coaxial, overlapping relationship. The interior of the cap includes a plurality of flanges radiating inwardly downward from the upper opening of the cap. By virtue of the manner in which they limit the interior diameter of the friction cap, the flanges resist movement of the sleeve and friction cap along the mop handle.

Due to the type of connection between the friction cap and the sleeve, however, it is common for the sleeve to pull away from the friction cap under the weight of the swab.

SUMMARY OF THE INVENTION

Accordingly, it is an object of the present invention to provide for a self-wringing mop wherein the swab may be replaced while minimizing user contact with the swab.

Yet another object of the present invention is to provide a self-wringing mop wherein the means for connecting the swab to the mop handle are simple such that the swab may be quickly and easily replaced while still permitting the swab to be wrung as necessary.

Relatedly, it is a further object of the present invention to provide a self-wringing mop having a minimal number of components, such that the mop is easy to manufacture, assemble, and use.

Still another object of the present invention is to provide simple and economical means to retain the sleeve of a self-wringing mop in the retracted position such that the mop may be hung in a vertical orientation to permit effective drying of the swab.

Still a further object of the present invention is to provide for the increased cleaning efficacy of the mop.

These and other objects of the present invention are accomplished according to an improved self-wringing mop of the type having an elongate handle with distal and proximal ends, a sleeve slidingly and rotatably disposed coaxially on the handle, and a swab both removably connected to the first end of the sleeve. The handle includes a first threaded member at the distal end thereof, the first threaded member comprising a threaded tip. The swab further includes a second threaded member whereby the swab is removably threadingly engaged with the first threaded member.

According to one feature of this invention, the mop includes indicia thereon in order to ensure that a user may either wring the swab or disconnect it from the handle as desired. The indicia identify both the direction of rotation of the sleeve necessary to remove the swab from the distal end of the mop handle and the direction of rotation of the sleeve necessary to wring the swab.

According to a further feature of the present invention, the sleeve is of the type used in cleaning instruments, such as the disclosed mop, and comprises an elongate body having first and second ends and a passageway extending therethrough for receiving a handle. The sleeve includes at least one flange projecting therefrom and interposed between the sleeve and the handle. The flange frictionally engages the exterior surface of the handle, preventing the sleeve from sliding along the handle under the weight of the swab. The at least one flange may be disposed adjacent the second end of the sleeve.

According to yet another feature, an abrasive scrub element is provided in association with a cleaning instrument of the type having a handle with distal and proximal ends and including a swab having first and second ends, the second end being engaged with the distal end of the handle. According to this feature, the scrub element is provided over the second end of the swab to increase the cleaning efficacy of the cleaning instrument. The abrasive scrub element may comprise a unitary scrub pad having at least two opposite ends. According to this feature, the second threaded member of the disclosed mop comprises first and second interconnecting halves. The opposite ends of the scrub paid are, fixedly sandwiched between the interconnecting halves such that the scrub element extends continuously over the second threaded member.

These and other objects and advantages of the present invention will become apparent upon reference to both the specification and the drawings.

DESCRIPTION OF THE ILLUSTRATED EMBODIMENT

Figure 1:
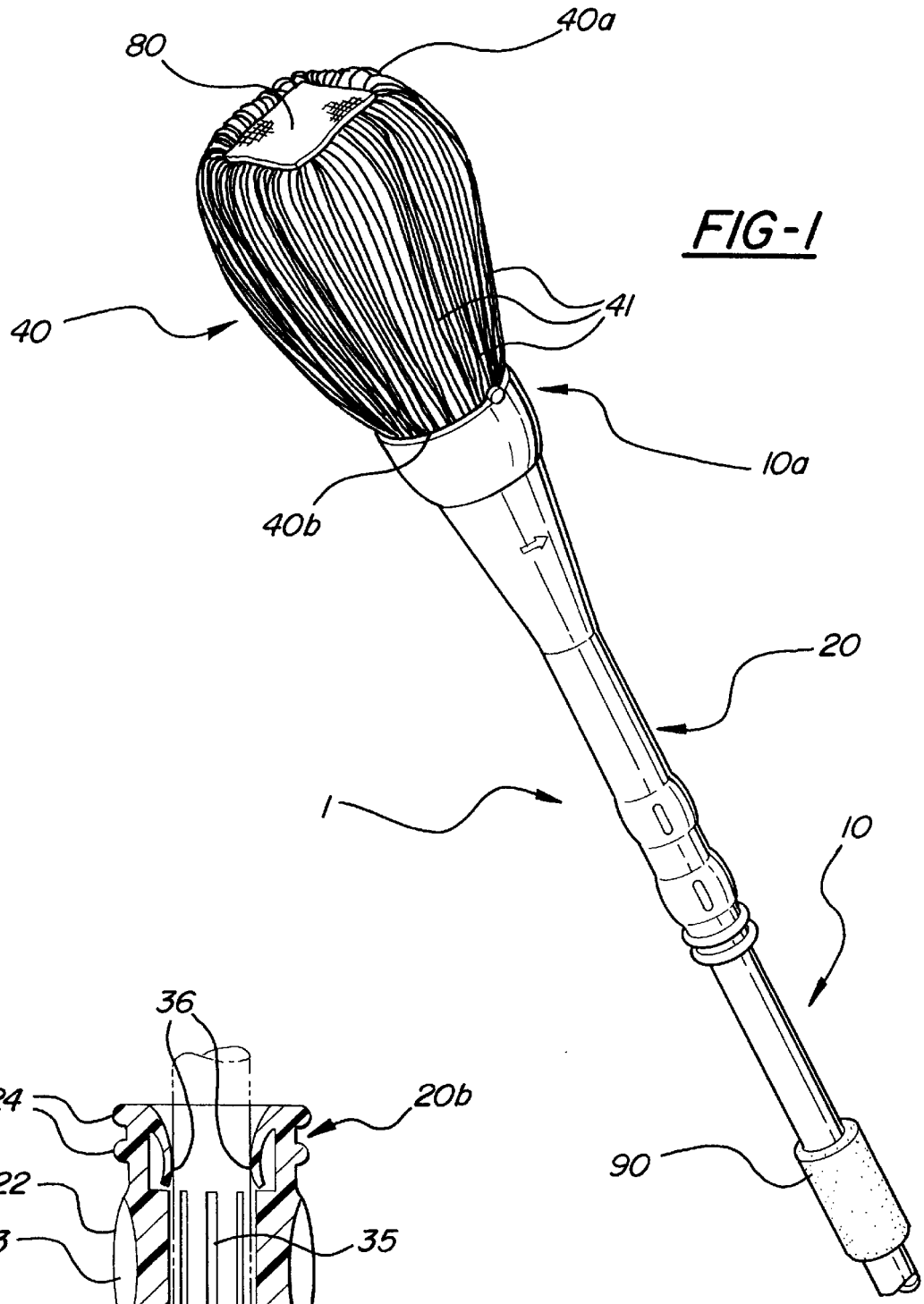
FIG. 1 is a perspective view of the mop of the present invention.

Referring now to FIG. 1, the improved mop 1 of the present invention generally comprises a comfortably hand-held, elongate handle 10 having a distal end 10*a* and a proximal end 10*b* (not shown in FIG. 1), a sleeve 20 rotatably and slidingly disposed coaxially on handle 10, and a swab 40 removably connected at first 40*a* and second 40*b* ends thereof to distal end 10*a* and sleeve 20, respectively. First and second correspondingly-threaded members (not shown in FIG. 1) associated with each of distal end 10*a* and swab 40, respectively, provide for the threading engagement of mop handle 10 and swab 40, as explained further hereinbelow. Abrasive scrub element 80 is disposed over first end 40*a* to improve the cleaning efficacy of mop 1. A coaxial grip sleeve 90 is further provided in fixed position along handle 10 towards proximal end 10*b*. Grip sleeve 90 is preferably constructed of foam rubber or like material, thereby affording a comfortable and conforming surface for a user's hand. To permit vertical hanging of the present inventive mop 1, proximal end 10*b* may further include a hook-engaging eyelet portion (not shown), such as are known in the art.

Figure 2:
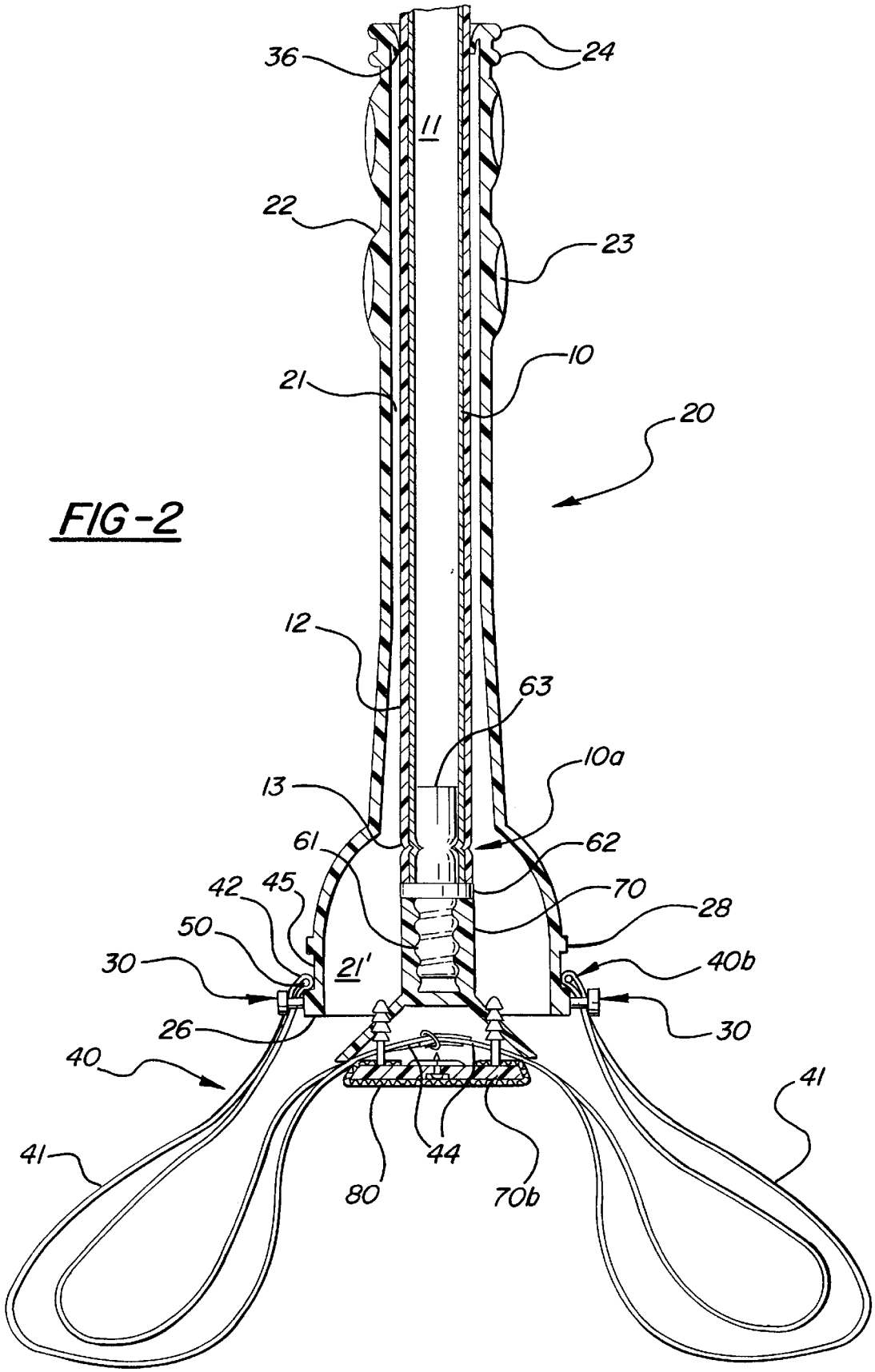
FIG. 2 is a lateral cross-section of the present inventive mop.

Referring also to FIG. 2, swab 40 preferably consists of a plurality of individual absorbent material elements 41 such as cotton yarn, chamois, sponge, or the like. Material elements 41 each preferably comprise a similar length of preferred material doubled back on itself to define an open loop 42 at second end 40*b* and free ends 44 at lower end 40*a*. Material elements 41 are gathered by tie strap 50, string, or like means extending through each loop 42, such as taught by Heinonen, U.S. Pat. No. 4,479,278, so as to define a circular opening 45 at second end 40*b* for receiving sleeve 20 therethrough as explained further herein. At free ends 44, individual material elements 41 are bound by string, wire, or the like.

Still referring to FIG. 2, handle 10 may be made of any desired material, including plastic, carbon fiber, wood, metal, or the like. To improve the feel and durability thereof, handle 10 preferably includes a thin plastic coating 12 applied to its exterior surface according to any of several processes well known to those of ordinary skill in the art. Handle 10 includes an opening therein which may take the form either of a blind bore in distal end 10*a* or a passageway extending longitudinally through the entirety of handle 10, as desired. According to the illustrated form, a hollow aluminum handle 10 is shown having a passageway 11. This preferred form of handle 10 decreases the overall weight of mop 1.

Figure 3:
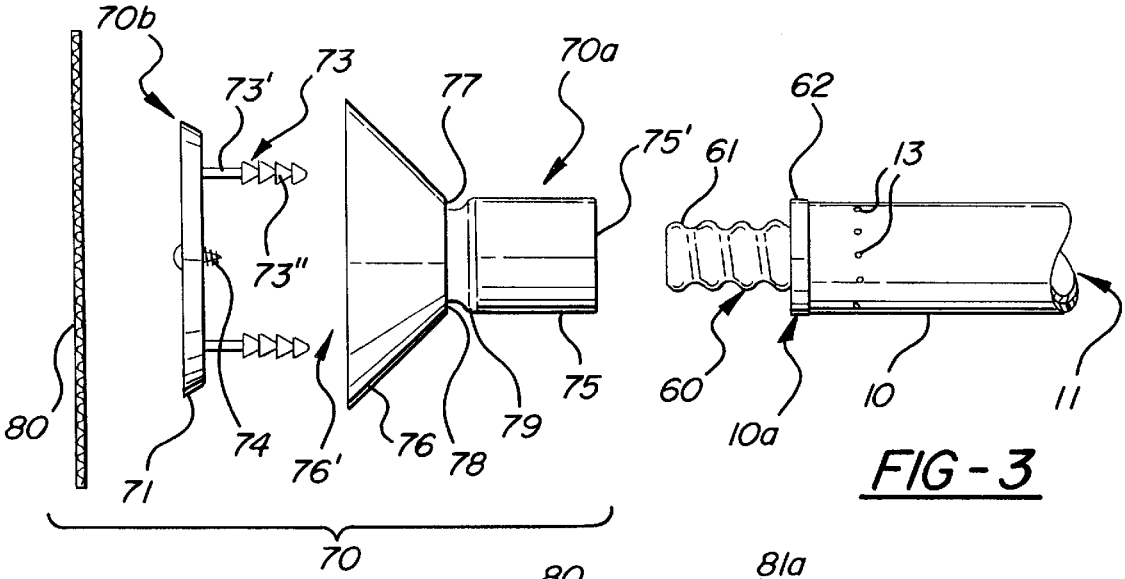
FIG. 3 is an exploded lateral view of the first and second halves of the second threaded member of the present invention.
Figure 5:
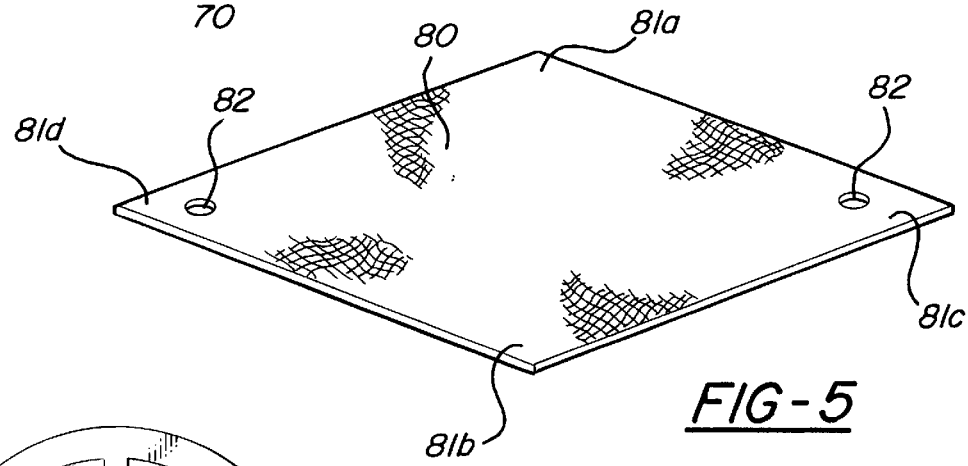
FIG. 5 is a perspective view of the scrub element of the present invention.
Figure 4:
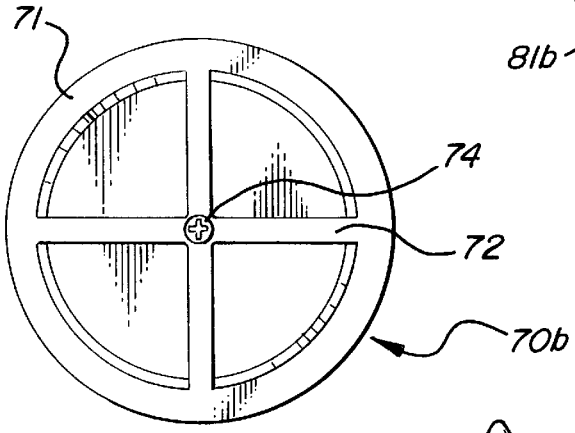
FIG. 4 is a top view of the second half of the second threaded member.

Protruding from distal end 10*a* of handle 10 is first threaded element 60 by which handle 10 is detachably connected to swab 40. (FIGS. 2 and 3.) In the illustrated form, first threaded element 60 comprises axially opposed threaded tip 61 and plug portion 63 separated by a radially extending, annular shoulder 62. The diameter of each of threaded tip 61 and plug portion 63 is approximately the same as the diameter of passageway 11 in handle 10, which in the illustrated form is around ¾ of an inch. Accordingly, first threaded member 60 is permanently affixed to distal end 10*a* of handle 10 by inserting plug portion 62 in passageway 11. Annular shoulder 62 prevents over-insertion of plug portion 63 into passageway 11, and to that end is characterized by a diameter generally equivalent to the exterior diameter of handle 10. As indicated, passageway 11 may alternately comprise a blind bore in distal end 10*a* of handle 10. To provide for abutting contact between annular shoulder 62 and distal end 10*a*, however, it is preferred that plug portion 63 fit substantially within handle 10. In the preferred form, the diameter of plug portion 63 is sufficient to insure a friction fit within passageway 11. However, glue or other adhesive may also be used to fixedly secure plug portion 63 to handle 10. Ideally, a plurality of equidistant stakes 13 are further made through handle 10 and about the circumference thereof. As shown, stakes 13 force a portion of the handle 10 radially inward to impact the exterior of plug portion 63, further ensuring against the unwanted withdrawal of first threaded portion 60. Of course, the foregoing is merely illustrative of one embodiment of the disclosed first threaded portion, and other forms are certainly possible. For example, it is equally conceivable that distal end 10*a* simply include an integral, threaded portion.

Turning now to FIGS. 3 through 6, second threaded member 70 comprises first 70*a* and second 70*b* axially interconnecting halves and includes both means for threadingly receiving threaded tip 61 of first threaded member 60, as well as means for securely fixing first end 40*a* of swab 40 thereto.

Second half 70*b* defines a locking element comprising a circular, frustoconically-shaped ring portion 71 having perpendicularly-oriented vanes 72 provided across the interior diameter thereof. Projecting perpendicularly from one side of the locking element are diametrically opposed locking prongs 73, each prong 73 comprising a first post 73' terminating in a barbed portion 73". Projecting from the center of second half 70*b* in the same perpendicular direction as each locking prong 73 is tang 74.

First half 70*a* defines coaxially abutting cylindrical 75 and frustoconical 76 portions each including, respectively, a longitudinally extending blind bore 75' and 76', bores having axially-opposed openings. In the illustrated form, bore 75' comprises means such as the illustrated socket for threadingly receiving threaded tip 61 of first threaded member 60. As shown, the exterior diameters of both cylindrical portion 75 and handle 10 are approximately the same, so as to define a substantially continuous exterior surface when both first 60 and second 70 threaded members are threadingly engaged. Bore 76' is frustoconical and has sufficient internal dimensions for receiving both the bound material elements at first end 40*a* of swab 40 and scrub element 80, portions of which are sandwiched between assembled first 70*a* and second 70*b* halves. (FIG. 3.) A pair of diametrically opposed bores 77 are provided in medial annular shelf 78 of frustoconical portion 76, each bore corresponding in location to the position of one of locking prongs 73. Bores 77 are preferably of sufficient size to permit passage in one direction of barbed portion 73" of each locking prong 73, thereby ensuring a fixedly secure engagement between first 70*a* and second 70*b* halves. In the illustrated form, cylindrical portion 75 further includes an annular groove 79 adjacent medial annular shelf 78 so as to accommodate locking prongs 73 as they extend from bores 77 when first 70*a* and second 70*b* halves are interconnected. Both halves 70*a* and 70*b* of second threaded element 70 are preferably manufactured from plastic, metal, or similarly strong material. In the illustrated form, both halves 70*a* and 70*b* are unitary, being molded from plastic according to known techniques.

Of course, it will be understood that second threaded element 70 as described is not critical to practicing the present invention. For example, while the illustrated form thereof is preferred, it is not required that swab 40 be fixedly secured to second threaded element 70 by the means described.

Figure 6:
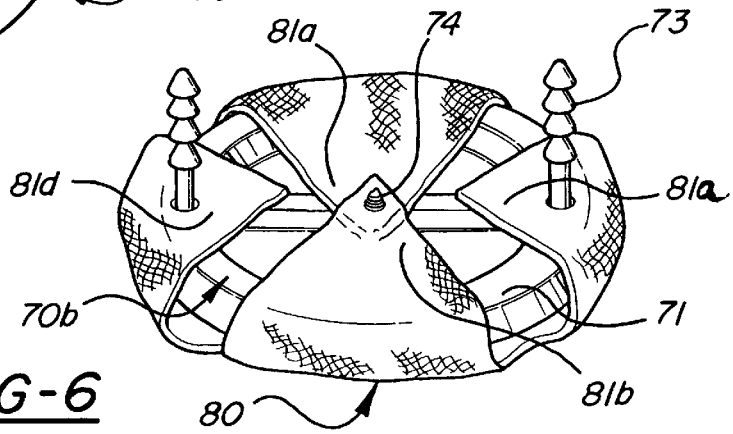
FIG. 6 is a perspective view of the abrasive scrub element and the second half of the second threaded member shown in an assembled condition.
Figure 7A:
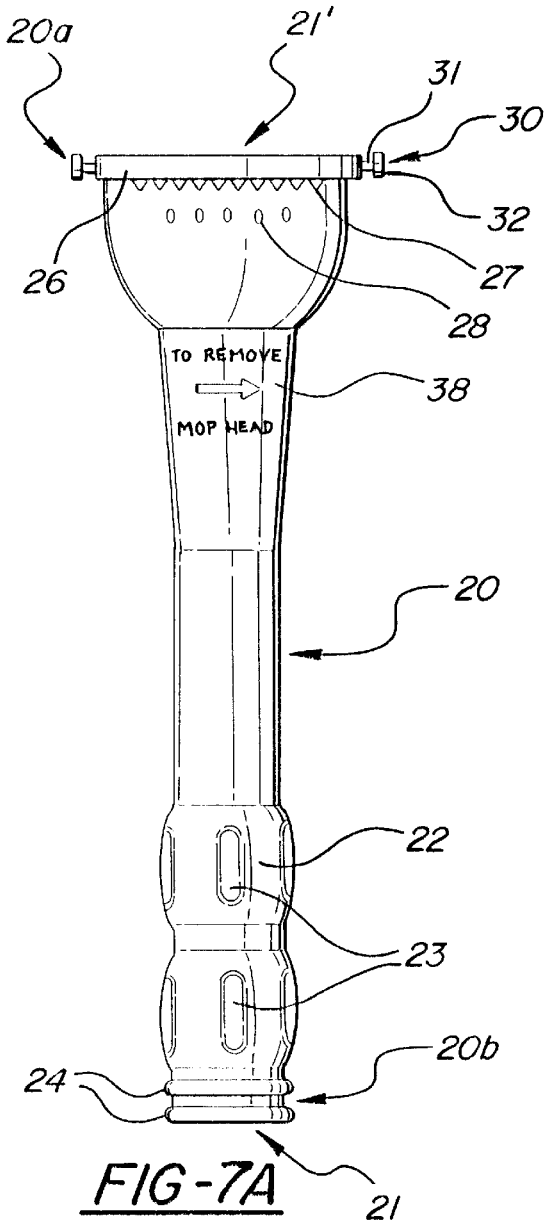
FIGS. 7A and 7B depict opposite lateral views of the sleeve of the present inventive mop.
Figure 7B:
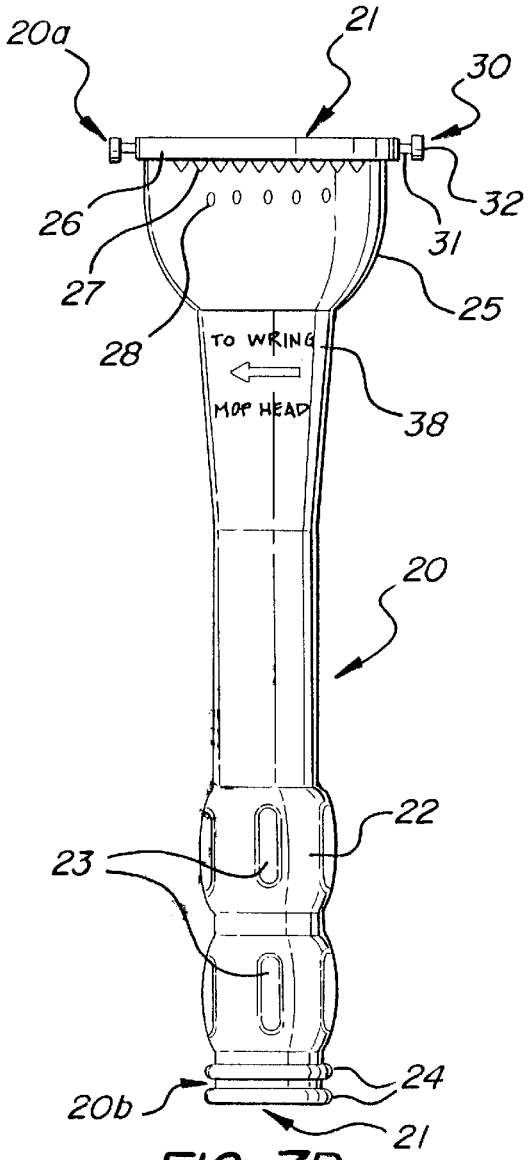
Figure 8:
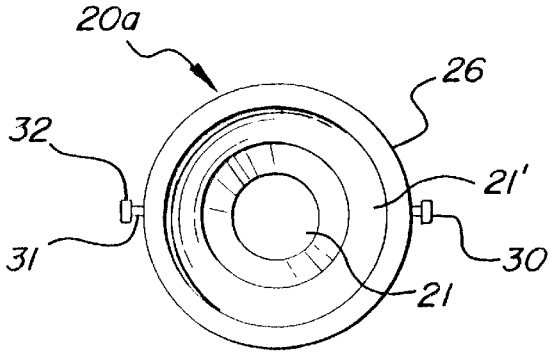
FIG. 8 is top view of the sleeve of FIGS. 7A and 7B.

Still referring to FIGS. 2 through 6, scrub element 80 may comprise any abrasive sponge-like material, and is preferably sufficiently coarse to improve the cleaning efficacy of the present inventive mop over typical mop swabs. As shown, scrub element 80 consists of a unitary, planar piece of such abrasive material having opposing free ends 81*a*, 81*b* and 81*c*, 81*d*. Adjacent two opposing ends 81*c* and 81*d* are provided bores 82, each bore corresponding in size and location to locking prongs 73 on second half 70*b* of second threaded element 70. In assembly, bores 82 are each engaged over one of locking prongs 73 such that scrub element 70 overlaps the top surface of the locking element. (FIG. 6.) To further secure scrub element 80, free ends 81*a* and 81*b* are forced over tang 74.

Turning now to FIGS. 7A through 10, sleeve 20 comprises a gently tapered, contoured tube having first 20*a* and second 20*b* ends, as well as a passageway 21 extending longitudinally therethrough by which sleeve 20 is slidingly and rotatably engaged coaxially over handle 10. Sleeve 20 is preferably manufactured from plastic or other lightweight, strong material and is characterized by a generally constant wall thickness with the exception of annularly swollen portions 22 described below. The diameter of passageway 21 increases constantly from second end 20*b* towards hemispherically-shaped cup portion 25, whereupon passageway 21 defines an expanded diameter hemispherical opening 21' for receiving a portion of swab 40 therein when sleeve 20 is fully extended toward distal end 10*a* of mop handle 10. In order to prevent undesired pivotal movement of sleeve 20 on handle 10, a plurality of longitudinally extending ribs 35 are provided within passageway 21. Ribs 35 define a constant diameter portion of passageway 21 corresponding to the exterior diameter of handle 10. The exterior diameter of cup portion 25 is approximately the same as the interior diameter of circular opening 45 defined at second end 40*b* of swab 40, such that second end 40*a* may be slideably inserted thereupon. To ensure that swab 40 cannot be removed over first end 20*a*, annular shelf 26 radiates outward from the first end 20*a*. Immediately adjacent shelf 26 on opposing exterior surfaces of cup portion 25 are provided two parallel, spaced rows of projections comprising teeth 27 and raised protrusions 28. Both rows of projections are oriented perpendicular with respect to the longitudinal axis of sleeve 20, such that when second end 40*b* of swab 40 is retained against shelf 26, teeth 27 and protrusions 28 each bite the material of swab 40 and ensure corresponding rotational movement of swab 40 during either wringing or removal thereof, as explained below. A first ear 30 is disposed on shelf 26 and radiates perpendicularly away from the longitudinal axis of sleeve 20. Ear 30 comprises a cylindrical post 31 terminating at its distal end in a disc-shaped cap 32 coaxial with and of greater diameter than post 31. As will be appreciated from the drawings, the location of ear 30 on sleeve 20 facilitates intercalation of ear 30 between individual material elements 41 of swab 40, further ensuring that rotation of sleeve 20 in a selected direction will result in the corresponding rotation of swab 40. As depicted, it is preferable to provide two such ears 30 radiating from diametrically-opposed surfaces of shelf 26.

Proximate the opposite, second end 20*b* of sleeve 20 are provided two integral, annularly swollen portions 22 of the sleeve wall. Each swollen portion 22 has provided in equidistant fashion about the circumference thereof a plurality of recessed, longitudinally-oriented grooves 23 which facilitate gripping of sleeve 20 during use. Two spaced, annular shoulders 24 immediately adjacent second end 20*b* also help to prevent a user's hand from disengaging sleeve 20.

As shown, mop 1 also includes indicia 38 thereon, these indicia 38 being in the form of either or both words and symbols. Though they may be provided anywhere on the mop 1 according to user preference or taste, indicia 38 are ideally included on sleeve 20 and comprise instructions for a user as to the appropriate direction of rotation for sleeve 20 in order to selectively wring swab 40 or threadingly disengage first 60 and second 70 threaded members in order to replace swab 40. Because first 60 and second 70 threaded members provide for the threading engagement of swab 40 and handle 10, it will be appreciated that the additional inventive feature of indicia 38 provide the user with a greater degree of control over the assembly and disassembly of this invention, as well as its operation.

Figure 10:
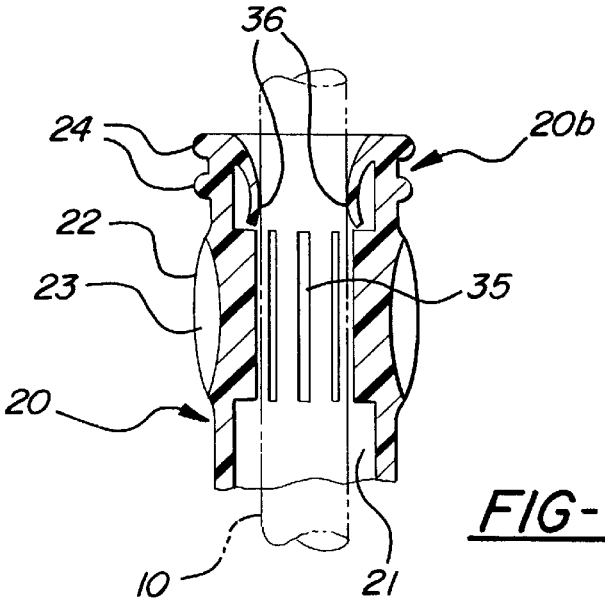
FIG. 10 is a detailed lateral cross-section of the upper end of the sleeve of the present invention.
Figure 9:
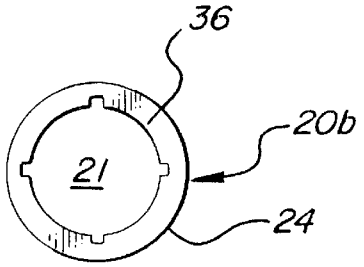
FIG. 9 is a bottom view of the sleeve of FIGS. 7A and 7B.

Referring now to FIGS. 9 and 10, the inventive means by which sleeve 20 may be retained in an extended position to effect drying of swab 40 will be better understood. As shown, a plurality of flanges 36 project radially inward and at a depressed angle from second end 20*b* adjacent the opening to passageway 21 so as to be interposed between the interior surface of sleeve 20 and handle 10 (shown in dashed lines). Each flange 36 provides a sufficiently increased area of contact between sleeve 20 and handle 10 so that sleeve 20 will not freely slide down the handle, while simultaneously permitting sleeve 20 to be rotatably and slidingly moved by a user with relative ease. As depicted, flanges 36 are preferably formed integral to sleeve 20 and comprise extensions of second end 20*b*. Of course, it will be understood that flanges 36 as described may be incorporated into sleeve 20 for use in a variety of cleaning instruments other than the mop disclosed herein.

Operation of this invention is best understood with reference to FIGS. 2 and 3. During use, a desired swab 40 is attached to mop 1 by threading engagement of first 60 and second 70 threaded members and slidingly inserting circular opening 45 of the swab over sleeve 20 as hereinbefore described. As with known self-wringing mops, extending sleeve 20 towards distal end 10*a* of handle 10 results in material elements 41 assuming a looped shape for mopping. In this configuration of mop 1, it will be appreciated that scrub element 80 serves not only to increase the mop's cleaning efficacy, but also to protect the mopped surface from damage (e.g., scratching, scraping, etc.) as it comes in contact with second half 70*b* of second threaded member 70. In order to selectively wring or remove swab 40, sleeve 20 is retracted away from distal end 10*a* such that swab 40 is longitudinally stretched. In this stretched configuration, swab 40 is wrung by firmly gripping handle 10 and rotating sleeve 20 in the appropriate direction as identified by indicia 38. The mop may then be hung in a vertically-oriented position with swab 40 in the stretched configuration for the efficient drying thereof; flanges 36 preventing sleeve 20 from otherwise freely sliding down handle 10 into an extended position. As swab 40 becomes worn out, or when a different style of swab is required for a new application, first 60 and second 70 threaded members may be disengaged by firmly gripping handle 10 and rotating sleeve 20 in the appropriate direction as identified by indicia 38. When first 60 and second 70 threaded members are disengaged, a user need only grasp second end 40*a* of swab 40 and slide the entire swab 40 towards proximal end 10*b* of handle 10.

Because the present invention comprises a heretofore unknown self-wringing mop capable of easy disassembly by virtue of the disclosed correspondingly-threaded first 60 and second 70 members, it will be appreciated that the present invention may be sold as a single, assembled mop or as separate component parts. And since handles having threaded tips are known in other applications, it is possible to provide for the sale of only those additional component parts necessary for a user to assemble the mop of this invention (i.e., sleeve 20, swab 40, and grip sleeve 90). In addition, the present invention is contemplated as being capable of supporting a variety of swabs, such as those comprising cotton yarn, chamois, or sponge-like material; each such swab having connected at one end thereof means for threadingly engaging the handle such as the second threaded member disclosed herein. Accordingly, a user may change swabs as desired or needed for a given application.

Of course, the foregoing is merely illustrative of one embodiment of the present invention. Many additions and modifications, apparent to those of ordinary skill in the art, are possible without departing from the spirit and broader aspects of this invention as defined in the appended claims.

The invention in which an exclusive property or privilege is claimed is defined as follows:

1. A self-wringing mop comprising an elongate handle with distal and proximal ends, a sleeve slidingly and rotatably disposed on said handle, and a swab both connected to said sleeve and removably threadingly connected to said distal end of said handle, said mop further including indicia thereon, said indicia identifying at least a direction of rotation of said sleeve necessary to wring said swab.

2. The mop of claim 1, further including a first threaded member comprising a threaded tip provided at said distal end of said handle, and a second threaded member connected to said swab, said second threaded member including a threaded socket removably threadingly engageable with said first threaded member.

3. The mop of claim 2, wherein said second threaded member comprises first and second interconnecting halves, and wherein further said mop includes a scrub element having at least two opposite ends, each of said ends being fixedly sandwiched between said first and second interconnecting halves such that said scrub element extends continuously over said second threaded member.

4. The mop of claim 3, wherein said first interconnecting half includes at least one locking prong projecting therefrom in a first direction and engageable with said second interconnecting half, and wherein said scrub element includes two bores, one adjacent each of said at least two opposite ends, each said bore coaxially engageable with said at least one locking prong.

5. The mop of claim 4, wherein said scrub element further includes a third end spaced apart from said at least two opposite ends, and said first interconnecting half further includes a tang projecting therefrom, said third end being engageable with said tang.

6. The mop of claim 1, wherein said sleeve includes first and second ends, and at least a first annular shoulder immediately adjacent said second end.

7. The mop of claim 1, said indicia further identifying a direction of rotation of said sleeve necessary to remove said swab from said handle.

8. The mop of claim 7, wherein said indicia are provided on said sleeve.

9. The mop of claim 1, said sleeve further including at least one flange projecting integrally therefrom and interposed between said sleeve and said handle, said at least one flange frictionally engageable with said handle.

10. The mop of claim 9, wherein said sleeve includes first and second ends, said at least one flange being provided adjacent said second end of said sleeve.

11. A self-wringing mop comprising:

an elongate handle having distal and proximal ends, said distal end including a first threaded member;

a sleeve slidingly and rotatably disposed on said handle;

a second threaded member detachably threadingly engageable with said first threaded member;

a swab both connected to said sleeve and connected to said second threaded member, such that said swab is removable from said distal end of said handle; and said mop including indicia thereon, said indicia identifying both a direction of rotation of said sleeve necessary to remove said swab from said handle and a direction of rotation of said sleeve necessary to wring said swab.

12. The mop of claim 11 wherein said indicia are provided on said sleeve.

13. The mop of claim 11, said sleeve further including at least one flange projecting integrally therefrom and interposed between said sleeve and said handle, said at least one flange frictionally engaging said handle.

14. The mop of claim 13, wherein said sleeve includes first and second ends, said at least one flange being provided adjacent said second end of said sleeve.

15. The mop of claim 11, wherein said second threaded member comprises first and second interconnecting halves, and a unitary abrasive scrub element having at least two opposite ends, each of said ends being fixedly sandwiched between said first and second interconnecting halves such that said scrub element extends continuously over said second threaded member.

16. The mop of claim 15, wherein said first interconnecting half includes at least one locking prong projecting therefrom in a first direction and engageable with said second interconnecting half, and wherein said abrasive scrub element includes two bores, one adjacent each of said at least two opposite ends, each said bore coaxially engageable with said at least one locking prong.

17. The mop of claim 16, wherein further said abrasive scrub element includes a third end, and said first interconnecting half further includes a tang projecting therefrom in said first direction, said third end being engageable with said tang.

18. The mop of claim 4, wherein said sleeve includes first and second ends, and at least a first annular shoulder immediately adjacent said second end.

19. A self-wringing mop, comprising:

an elongate handle having distal and proximal ends, said distal end including a first threaded member;

a sleeve slidingly and rotatably disposed on said handle, said sleeve including at least one flange projecting integrally therefrom and interposed between said sleeve and said handle, said at least one flange frictionally engaging said handle;

a second threaded member detachably threadingly engageable with said first threaded member;

a swab both connected to said sleeve and connected to said second threaded member, such that said swab is removable from said distal end of said handle; and said mop including indicia thereon, said indicia identifying both a direction of rotation necessary to remove said swab from said handle and a direction of rotation necessary to wring said swab.

20. The mop of claim 19, wherein said second threaded member comprises first and second interconnecting halves, and further including a scrub element having at least two opposite ends, each of said ends being sandwiched between said first and second interconnecting halves such that said scrub element extends continuously over said second threaded member;

wherein said first interconnecting half includes at least one locking prong projecting therefrom in a first direction and engageable with said second interconnecting half, and wherein said scrub element includes two bores, one adjacent each of said at least two opposite ends, each said bore coaxially engageable with said at least one locking prong.

21. The mop of claim 20, wherein said scrub element further includes a third end spaced apart from said at least two opposite ends, and said first interconnecting half further includes a tang projecting therefrom, said third end being engageable with said tang.

* * * * *

UNITED STATES PATENT AND TRADEMARK OFFICE

CERTIFICATE OF CORRECTION

PATENT NO. : 5,875,509

DATED : March 2, 1999

INVENTOR(S) : Facca

It is certified that error appears in the above-indentified patent and that said Letters Patent is hereby corrected as shown below:

Column 2, line 43, after "the" (first occurrence), insert --distal end of the handle and connected to the--;

Column 4, line 6, delete "lower" and insert --first--.

Signed and Sealed this

Seventh Day of December, 1999

*Attest:*

Q. TODD DICKINSON

*Attesting Officer*

*Acting Commissioner of Patents and Trademarks*